US005984028A

United States Patent [19]

Wilson

[11] Patent Number: 5,984,028

[45] Date of Patent: Nov. 16, 1999

[54] CONVERTED DUAL-ACTING HYDRAULIC DRILLING JAR

[75] Inventor: Timothy L. Wilson, Houston, Tex.

[73] Assignee: Dailey Petroleum Corp., Conroe, Tex.

[21] Appl. No.: 08/893,207

[22] Filed: Jul. 15, 1997

[51] Int. Cl.[6] ..... E21B 31/113

[52] U.S. Cl. ..... 175/297; 166/178

[58] Field of Search ..... 175/296, 297; 166/178

[56] References Cited

U.S. PATENT DOCUMENTS 4,361,195 11/1982 Evans ..... 175/297

5,086,853 2/1992 Evans ..... 175/297

5,318,139 6/1994 Evans ..... 175/297

5,466,546 11/1995 Evans ..... 175/297

*Primary Examiner*—David J. Bagnell

*Attorney, Agent, or Firm*—Arnold White & Durkee

[57] ABSTRACT

A jar up, bump down hydraulic drilling jar is described. A hydraulic tripping valve arrangement permits the storage of large amounts of static force before releasing a hammer to strike an anvil surface with substantial force. The hammer is positioned on the mandrel and interacts with the anvil surface in the housing to deliver upward jarring forces, to the drill string. During a downward jarring movement, the tripping valve is opened to prevent pressure buildup and accidental downward jarring; thus, a single-acting drilling jar is formed.

15 Claims, 7 Drawing Sheets

CONVERTED DUAL-ACTING HYDRAULIC DRILLING JAR

BACKGROUND OF THE INVENTION

The invention relates in general to the field of drilling equipment and, more particularly, to the use of dual-acting hydraulic drilling jars. Specifically, the invention relates to the conversion of a bi-directional, dual-acting drilling jar to a single-acting drilling jar.

The jar is normally placed in the pipe string in the region of the lodged object and allows the drilling rig operator at the surface to deliver an impact to the fish through manipulation of the drill pipe string. Jars contain a spline joint which allows relative axial movement between an inner mandrel or housing and an outer housing without allowing relative rotational movement. The mandrel or inner housing contains an impact surface or hammer which contacts a similar impact surface or anvil on the housing when the jar has reached the limit of axial travel. If these impact surfaces are brought together at high velocity, they transmit a very substantial impact to the fish due to the mass of the drill pipe above the jar.

Most drilling jobs require that both an upward and downward jar be available in the drilling string. For example, during the drilling of an oil or gas well, the pipe may become stuck due to hole sloughing or differential pressure sticking such that it would be desirable to jar the pipe upward. The pipe may also become lodged in a keyseat while "tripping" (i.e., removing the pipe from the well bore) in which case it would be desirable to jar downward on the stuck point. Bi-directional hydraulic drilling jars are used for such a purpose and are described in U.S. Pat. No. 4,361,195, issued Nov. 30, 1982, and U.S. Pat. No 5,086,853, issued Feb. 11, 1992, both to Robert W. Evans, which are hereby incorporated by reference in their entirety.

More particularly, U.S. Pat. No. 4,361,195 describes an annular tripping valve that cooperates with a pair of control arms to provide the "dual action." As shown in FIG. 1, the drilling jar of U.S. Pat. No. 4,361,195 is connected in a drill string at its upper threaded opening 2 and connected to a bottom hole assembly to which a jarring action is to be applied at its lower threaded connection 4 or sub 6. To provide a downward jarring function, tension force is released from the upper drill pipe, thereby placing it under compression. This, in turn, applies a compressive force downward against mandrel 8 and attempts to move the mandrel downward in relation to housing 10. The initial downward movement of mandrel 8 occurs relatively freely, with the movement being a sliding movement relative to housing 10 and to pressure pistons 12 and 14. During this phase of movement, shoulder 16 of sleeve member 18 is brought into engagement with the top surface of pressure piston 12. At this point, further movement of mandrel 8 will cause shoulder 16 to move pressure piston 12 downward inside fluid pressure chamber 22. Thus, the movement causes pressure piston 12 to move away from shoulder 20 on which it is positioned when the apparatus is in the neutral position shown in FIG. 1.

Such movement of pressure piston 12 by shoulder 16 of mandrel 8 causes actuating members or control arms 24 to move the end flange portion 26 until it engages the end flange 28 on tripping valve member 30. Further movement of pressure piston 12 will cause tripping valve member 30 to be moved while maintaining the same relative position to valve opening 32. As tripping valve member 30 moves downward, tripping valve member 34 follows valve member 30 in downward movement under the influence of spring 36 and the elevated pressure in chamber 22 compresses both valve parts tightly together. When the valve member 34 is moved downwardly by the pressure in chamber 22 and spring 36 (i.e., following the movement of valve member 30 by control arm 24), valve member 34 is moved relative to control arm 40 extending from lower pressure piston 14. The end flange 42 of control arm 40 remains in a stationary position, while valve member 34 moves past it, until end flange 44 of valve member 34 engages flange 42. At this point, any further movement of pressure piston 12 toward piston 14 will cause the relative movement of control arms 40 and 24 to begin to separate the valve members 34 and 30 which comprise tripping valve 46.

Up to this point, the relative movement of pressure piston 12, pressure piston 14, and control arms 24 and 40 has been described as if the movement were unobstructed. It should be noted, however, that fluid pressure chamber 22, which is enclosed by pressure pistons 12 and 14, as well as tripping valve 46, is a completely closed chamber except for the very small opening or orifice 48 through piston 12. The downward movement of piston 12 pressurizes the hydraulic fluid in chamber 22. The fluid pressure resists movement of the piston. As the compressive force applied to mandrel 8 is increased by the weight applied by the drill string above the drilling jar, the hydraulic pressure in fluid chamber 22 increases as a result of the load imposed on pressure piston 12. The check valve 50 in pressure piston 14 prevents the flow of fluid outward through piston 14. The closed valve members 34 and 30 of tripping valve 46 also prevent the flow of hydraulic fluid from the chamber at that point. It should be noted that the closed valve members 34 and 30 are urged into tighter closure due to the elevated pressure in chamber 22 acting on an annular area from the valve seal point to the outer surface 52 of sleeve 54. The only point of exit of fluid from chamber 22 during this phase of operation is through the very small bleed passage 48 in piston 12. The size of bleed passage 48 is such that the hydraulic fluid can flow through it at a very slow rate only when subjected to a relatively high pressure.

As the force applied to pressure piston 12 increases, piston 12 tends to move downward in chamber 22, however, it is resisted by the fluid in the chamber and can move only as fluid leaves through orifice 48. The fluid in chamber 22 is therefore maintained under a very high pressure and, as piston 12 moves slowly downwardly to maintain the pressure in chamber 22, fluid flows from chamber 22 through opening 48. When pressure piston 12 has moved downward to the point where end flanges 26 and 42 of control arms 24 and 40 have reached engagement with the end flanges 44 and 28 of valve members 34 and 30 and forced the valve members to separate, the hammer 56 on mandrel 8 has moved only a fraction of the distance downward toward anvil 58. At this point, mandrel 8 is under a very high compressive force applied by the drill string above and will release that force to move hammer 56 at a high speed and with a high impact against anvil 58 whenever the resistance to further movement is released.

Further downward movement of pressure piston 12 relative to piston 14 will cause the end flanges 26 and 42 of control arms 24 and 40 to move valve members 34 and 30 apart to open the tripping valve 46. When the tripping valve 46 is opened, the fluid in hydraulic fluid chamber 22 is permitted to flow out through the opened tripping valve 46, opening 32, and the various passages to the various fluid chambers which are not under elevated pressure. Thus, when tripping valve 46 is opened, the fluid in chamber 22 can flow through passages 60 and 62 into fluid chamber 64 located above the downwardly moving pressure piston 12. Fluid is also free to move from chamber 22 through passage 60 downwardly into fluid chamber 66 above pressure balancing piston 68. This sudden release of fluid from chamber 22 releases virtually all resistance to downward movement of pressure piston 12. At this point, piston 12 moves rapidly downward under the influence of the high potential energy built up by the compression and weight of the drill string. The rapid downward movement of piston 12 allows mandrel 8 to move along with it very rapidly and causes hammer 56 to bring hammer face 70 into engagement with anvil surface 58 with a very high impact force. For the sake of brevity, the description of upward jarring, which is quite similar to downward jarring is described in detail in U.S. Pat. No. 4,361,195, and is incorporated here by reference.

U.S. Pat. No. 5,086,853 describes a hydraulic tripping valve in a drilling jar that cooperates with alternating pairs of flanges to provide both upward and downward jarring. The jar of U.S. Pat. No. 5,086,853 is shown in FIG. 2. As discussed in conjunction with the jar of U.S. Pat. No. 4,361,195, mandrel 72 and, consequently, actuating mechanism 76, move downward relative to housing 74.

Mandrel 72 moves sufficiently downward so that flange 76 is longitudinally moved and contacts actuating surface 78 of valve member 80, at which point, neither of valve members 82, 80 of tripping valve 84 are longitudinally displaced by movement of mandrel 72. Also, coil springs 86, 88 will generally maintain the position of tripping valve 84 at its central location in chamber 90.

As mandrel 72 and flange 76 move further downward, they will carry with them tripping valve 84. At this point, valve members 82, 80 will still have not separated, owing to the force of coil springs 86, 88, combined with the rising internal pressure of chamber 90. It will be appreciated that the downward movement of mandrel 72 carries with it upper piston 92, thereby reducing the volume of chamber 90 and, consequently, increasing the internal pressure. The internal pressure of chamber 90 acts against the outer surfaces of the valve members 82, 80 and urges them together to maintain their closed position. The tripping valve 84 is carried downward to a point where flange 94 on the valve member 82 engages flange 96 of housing 74.

Continual downward movement of mandrel 72 and flange 76 forces valve members 82, 80 into their separated or "open" position. The upper valve member 82 is restrained against further downward movement by the interaction of flange 94 and housing flange 96. However, further downward movement of mandrel 72 forces flange 76 against actuating surface 78 of lower valve member 80, causing it to separate from upper valve member 82. With high pressure chamber 90 opened to passages 98, hydraulic fluid quickly flows out of chamber 90 and reduces the pressure therein. With the pressure in chamber 90 substantially reduced, downward movement of the mandrel relative to housing 74 is no longer resisted by a substantial force. Thus, mandrel 72 now moves rapidly downward into housing 74 causing hammer 100 to sharply strike lower anvil surface 102. In contrast, an upward jarring action begins by mandrel 72 being withdrawn or pulled upward and out of housing 74. The upward jarring motion is similar to the downward jarring motion except flanges 104, 96 and 76 are used as described in detail in the U.S. Pat. No 5,086,853 patent.

A drill string in a well is typically several thousand feet in length. Gravity acts on the drill string causing a downward force to be placed on the drill string; the downward force of gravity is countered by an upward force exerted by the object that is holding the drill string. The two opposing forces causes the portion of the drill string above the neutral point to be stretched (i.e., have a tensile force applied). In contrast, the bottom hole assembly (i.e., the portion of the drill string below the neutral point which contains the drilling bit) is constantly encountering undrilled formations. The resistance of formations to movement results in an upward force being placed on the drill bit; the force of gravity associated with the weight of the bottom hole assembly exerts a downward force on the drill bit. These two opposing forces cause the bottom hole assembly to be in compression.

If a drilling jar is to be placed in the bottom hole assembly close to the drill bit, the ability to have a single-acting drilling jar becomes desirable. Typically, drilling jars have a maximum pressure that must be met in order for them to "cock" (i.e., prepare to exert an impact). When drilling jars are placed in the bottom hole assembly, the jar experiences the compressive forces associated with that region. The ratio of the compressive forces to the area is equivalent to pressure; if the pressure from compressive forces becomes greater than the pressure requirement for "cocking", the jar will prepare to exert a downward jar. When an unexpected downward jar occurs in the bottom hole assembly, there can be major repercussions. For example, it may be undesirable to jar downward when drilling in a hard formation because of possibly damaging the drill bit.

The present invention is directed towards overcoming some of the disadvantages of the prior art by providing a drilling jar that jars in the upward direction and only "bumps" in the downward direction.

SUMMARY OF INVENTION

The invention relates to the conversion of a dual-acting hydraulic drilling jar to a single-acting drilling jar. A hydraulic tripping valve arrangement permits the storage of large amounts of static force before releasing a hammer to strike an anvil surface with substantial force. The hammer is positioned on a mandrel and interacts with anvil surfaces in the housing to deliver upward jarring forces to the drill string. During a downward movement, the tripping valve is opened to prevent pressure buildup and accidental downward jarring; thus, a single-acting drilling jar is formed.

DETAILED DESCRIPTION OF SPECIFIC EMBODIMENTS

Overview

Figure 1:
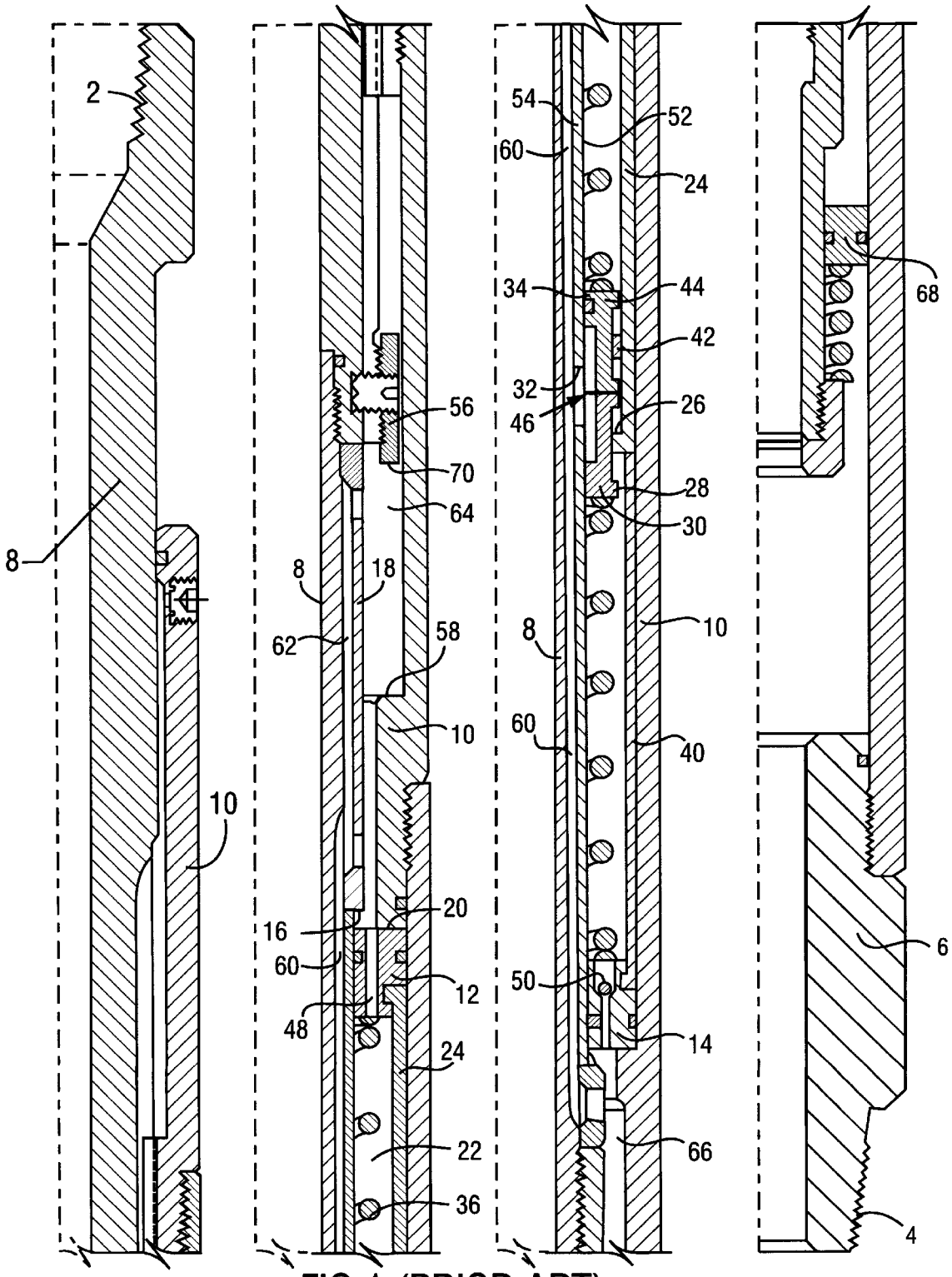
FIG.1 (PRIOR ART)
FIG. 1 illustrates a first conventional dual-acting drilling jar.
Figure 2:
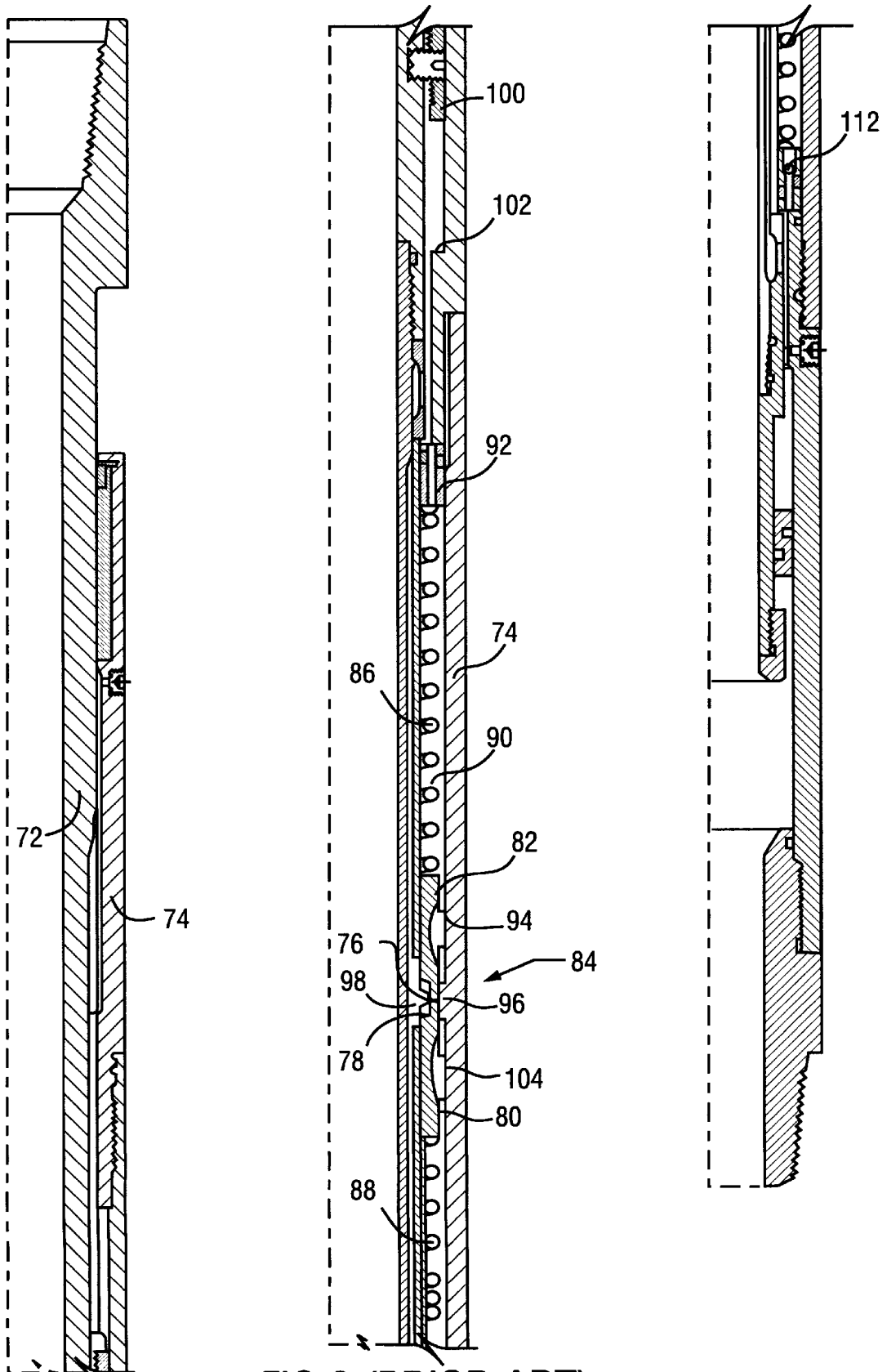
FIG.2 (PRIOR ART)
FIG. 2 illustrates a second conventional dual-acting drilling jar.
Figure 3:
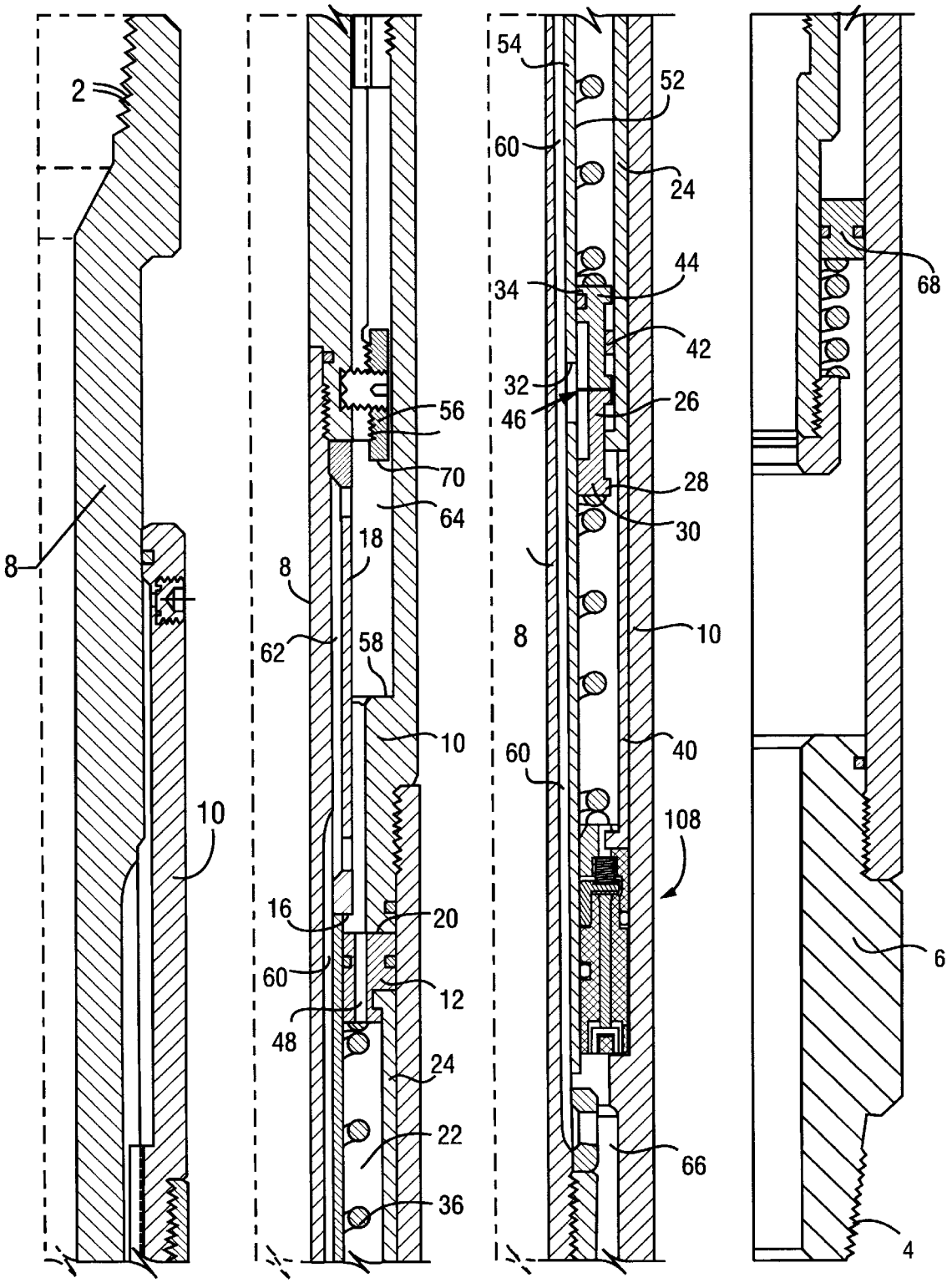
FIG. 3 illustrates a first embodiment of a hydraulic drilling jar in accordance with the invention.

FIGS. 3 and 4 illustrate two embodiments of a dual-acting hydraulic drilling jar converted to a single acting (jar up, bump down) drilling jar in accordance with this invention. This invention, therefore, can be designed for use with either one of the prior art hydraulic drilling jars shown in FIGS. 1 and 2. The invention results in single-acting jars which jar upward and "bump" downward, rather than jar up and jar down. As known in the art, a "bump" refers to mechanical movement that occurs without significant amounts of pressure. Jar up, bump down jars have certain advantages, i.e., it enables a drill string to be replaced without possibly damaging portions of the bottom hole assembly because of an unexpected downward jar.

A First Embodiment

Figure 4A:
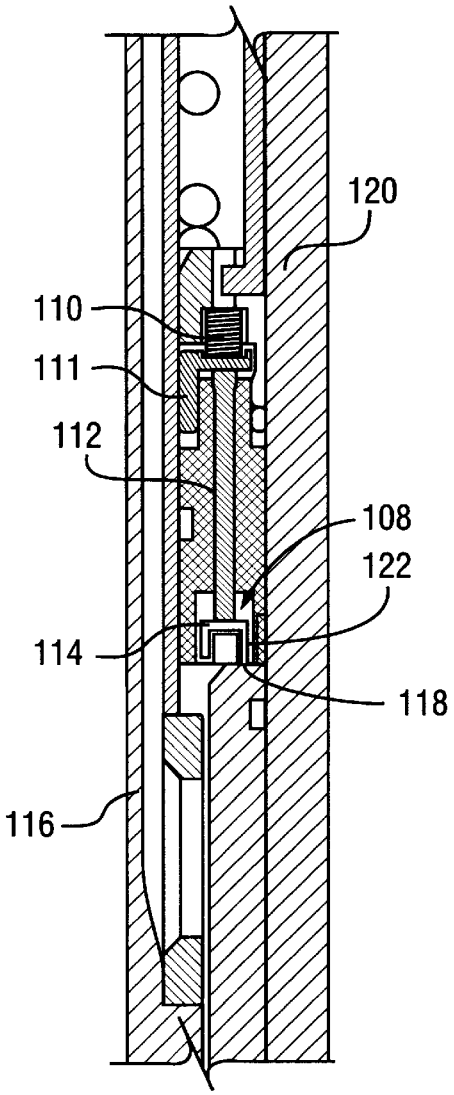
FIGS. 4A and 4B illustrate enlarged views of the piston shown in FIG. 3.
Figure 4B:
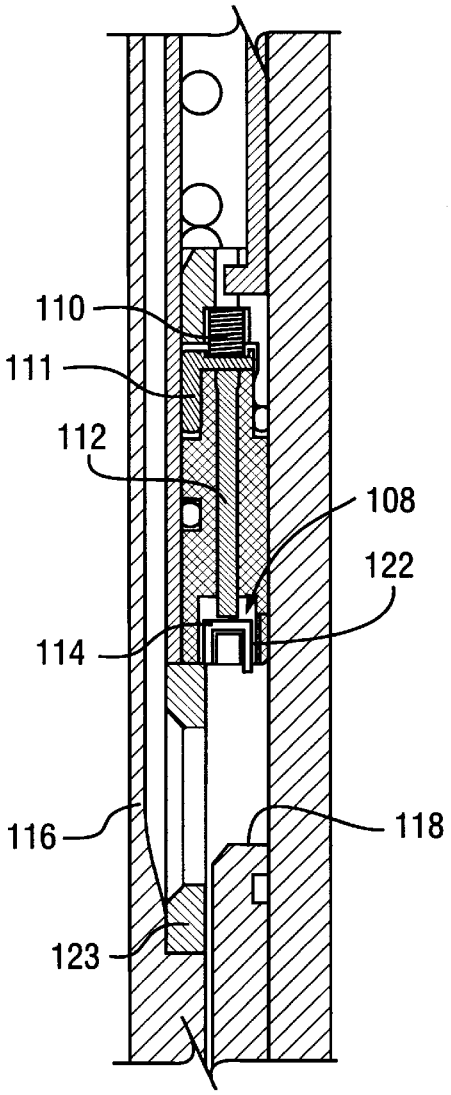

In a first embodiment shown in FIG. 3, a hydraulic drilling jar with actuating arms is shown. The major components of this drilling jar (i.e., the mandrel, hammer, and anvil) function the same way they do in prior art drilling jars such as the one depicted in FIG. 1. However, this embodiment has a conversion mechanism which features a newly designed lower piston 108. An enlarged view of piston 108 is shown in FIGS. 4A and 4B. Piston 108 includes a spring 110, a rod 112, and a bump plate 114.

Figure 4C:
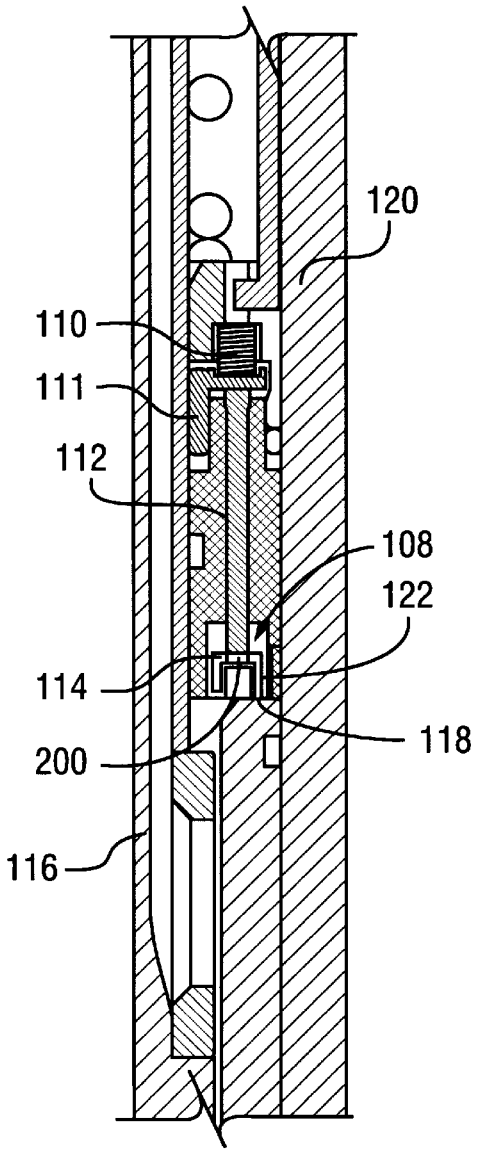
FIG. 4C illustrates the enlarged view of FIG. 4A sectioned at a different point on the circumference of the hydraulic drilling jar of the invention.
Figure 4D:
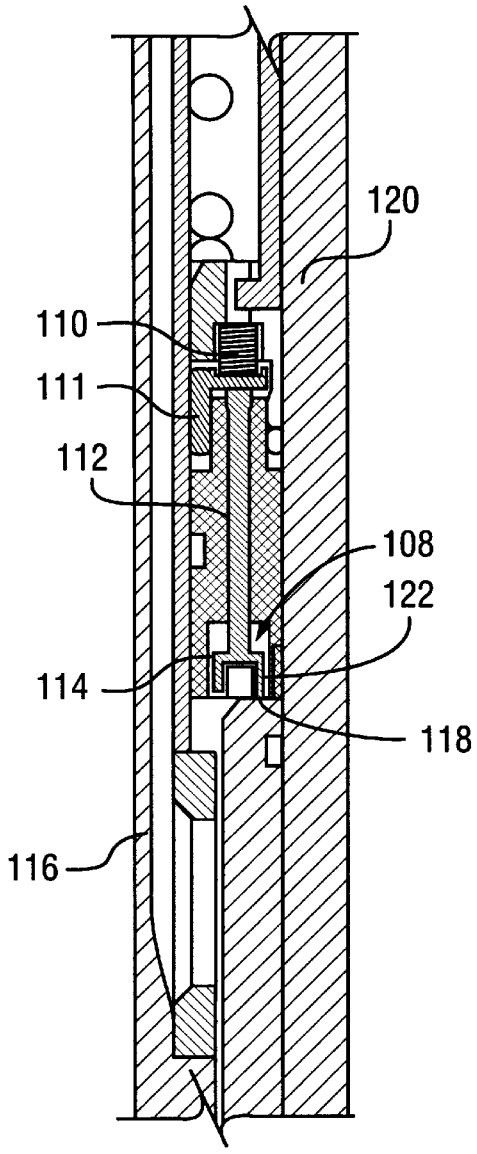
FIG. 4D illustrates an embodiment of the invention as shown in FIG. 4A wherein the rod and bumper plate are connected to form one object.

When mandrel 116 of the jar is pushed downward, as in the case of insertion of the pipe string in a well, piston 108 moves towards the actuating surface 118 of housing member 120. The longer leg 122 of bumper plate 114 engages actuating surface 118 as shown in FIG. 4A. FIG. 4C illustrates flow holes 200 in the bumper plate 114. It will be appreciated by those of skill in the art that the flow holes are not shown in FIG. 4A based on the position of the sectional view. One skilled in the art will appreciate that when the jar is in the neutral position, piston 108 also engages the actuating surface 118 of the housing 120. The bumper plate 114 engages rod 112 which, in turn, compresses spring 110. It will be appreciated by those of skill in the art that rod 112 and bumper plate 114 may be separate objects, as shown in FIGS. 4A and 4B, or may be connected to form one object as shown in FIG. 4D. Compression of spring 110 holds check valve 111 open which does not allow pressure to build up; the check valve causes the tripping valve (not shown) to open, enabling the fluid in the pressure chamber to escape. The escape of fluid prevents pressure build up in the chamber even though it is being compressed, thereby preventing a jarring action in the downward direction.

In contrast, when the mandrel 116 is pulled upward it engages the spacer 123 which engages piston 108 without engaging the bumper plate 114 because of the length differential between the two legs of the bumper plate; this length differential allows the check valve to close. The movement of the piston 108 causes a volume reduction in the hydraulic chamber which causes pressure to build inside of the chamber. Since only a small amount of liquid is leaking through an upper piston, pressure builds until the tripping valve opens, thereby causing the pipe string to jar upward.

A Second Embodiment

Figure 5:
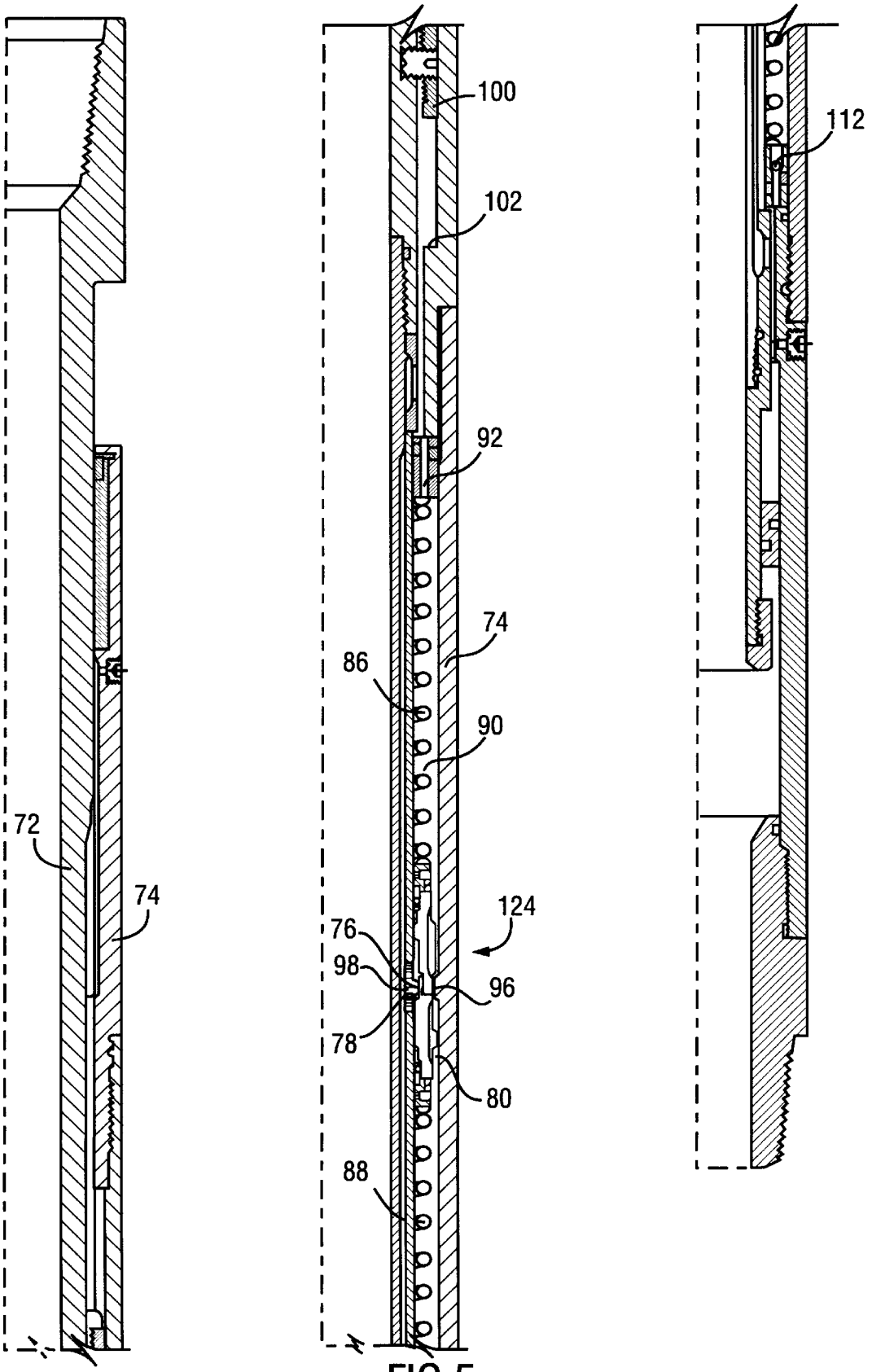
FIG. 5 illustrates a second embodiment of a hydraulic drilling jar in accordance with the invention.

In a second embodiment shown in FIG. 5, a hydraulic drilling jar with a conversion mechanism including a redesigned tripping valve 124 composed of alternate pairs of flanges is shown. As in the first embodiment, the major components of the drilling jar function the same way as prior art drilling jars, particularly the prior art jar shown in FIG. 2. An enlarged view of the tripping valve 124 is shown in FIG. 6.

Figure 6:
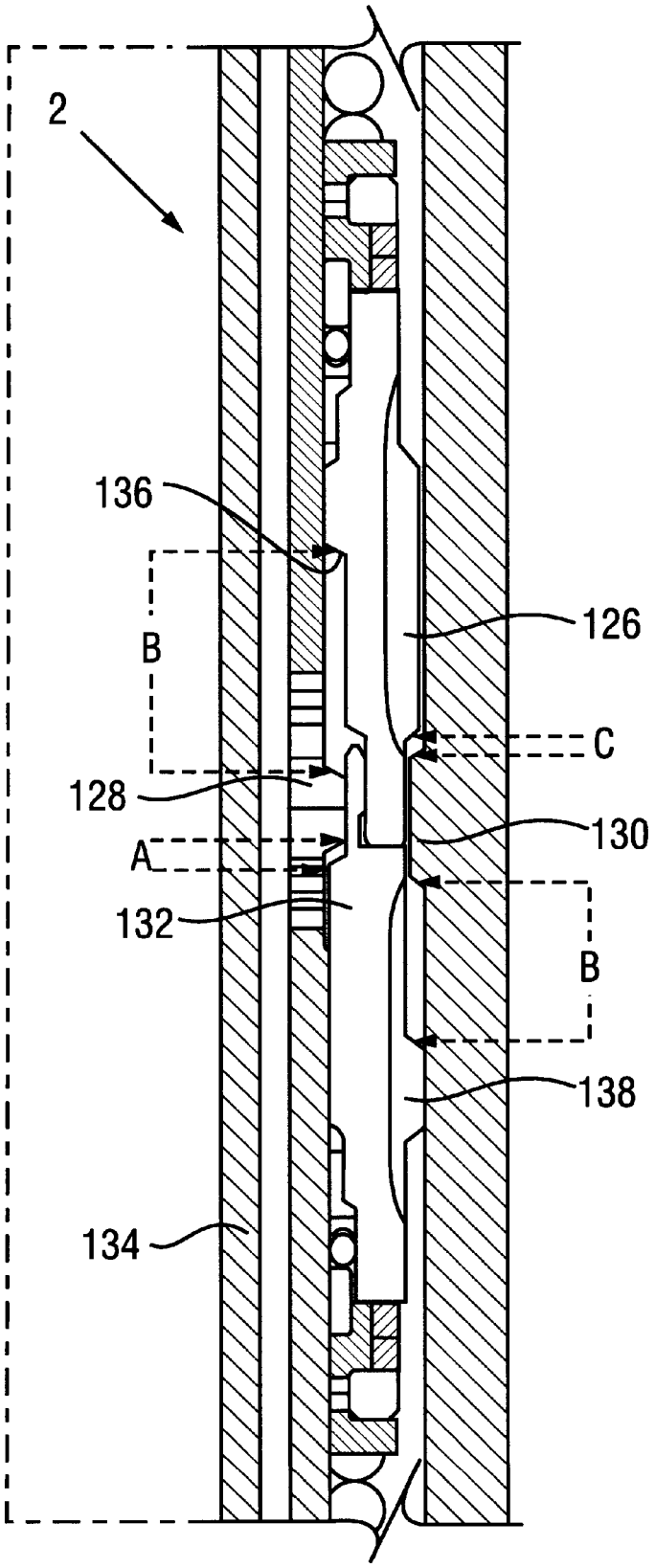
FIG. 6 illustrates an enlarged view of the tripping valve shown in FIG. 5.

Referring to FIG. 6, the second embodiment includes a first pair of flanges 126 and 128 are used in downward jarring. The distance between flange 126 and flange 130 is essentially the same as the distance between flange 128 and actuating surface 132 which is shown as A. During downward jarring, the mandrel 134 is depressed causing the flange 128 to engage the actuating surface 132 after moving a distance shown as A. Continued downward motion of the mandrel causes flange 128 to push actuating surface 132 causing the entire tripping valve to move downward such that flange 126 engages flange 130. Any further motion by the mandrel will cause the tripping valve to open, releasing liquid from the hydraulic chamber; this prevents pressure build-up. In this embodiment, mandrel 134 moves a distance A until it engages actuating surface 132, and then further moves a distance C until flange 126 engages flange 130, at which point, the tripping valve is open to release the hydraulic liquid. Such a pressure release reduces the likelihood of downward jarring when the pipe string is being re-inserted into the well.

In contrast, when mandrel 134 is pulled upward, flange 128 engages actuating surface 136 causing the tripping valve to move upward. Additional movement causes tripping valve to further move, thus enabling flange 138 to engage flange 130 after a distance shown as B. One skilled in the art will realize that the movement of the flanges is a result of the movement of a pressure piston (not shown). Additional movement by mandrel 134 causes the tripping valve to open, thereby causing an upward jarring motion. The distance between flange 130 and flange 138, which is shown as B, is essentially the same as the distance between flange 128 and actuating surface 136. The difference between distances A and B enables an upward jar to occur while only allowing for a downward bumping action to occur. The actual dimensional values, as well as the ratios (e.g., two to one), of A to B can be selected to meet specific drilling needs.

It will be appreciated by those of ordinary skill in the art having the benefit of this disclosure that numerous variations from the foregoing illustration will be possible without departing from the inventive concept described therein. Accordingly, it is the claims set forth below, and not merely the foregoing illustration, which are intended to define the exclusive rights claimed.

What is claimed is:

1. A pressure piston for use in a hydraulic drilling jar consisting of a tubular mandrel and a hydraulic chamber, said piston comprising:

a) a bump plate having first and second ends;

b) a rod having first and second ends, wherein said first end of said rod is in contact with said second end of said bump plate;

c) a spring having first and second ends, wherein said first end of said spring is in contact with said second end of said check valve; and d) a check valve in contact with said second end of said rod, wherein movement of said rod in a first direction allows said spring to close said check valve and movement of said rod in a second direction opens said check valve.

2. The piston of claim 1 wherein said rod is made of a solid material.

3. The piston of claim 1 wherein said bump plate includes flow holes.

4. The piston of claim 1 wherein said rod and said bump plate are connected to form one object.

5. The piston of claim 1 where said bump plate further comprises a first end having first and second legs.

6. The piston of claim 5 wherein said length of said first leg is greater than said length of said second leg.

7. The piston of claim 6 wherein said first leg operatively contacts with said mandrel.

8. The piston of claim 6 wherein said first leg is not in contact with said mandrel.

9. A hydraulic jar for connection in a tubular earth drilling string comprising:

a) outer and inner tubular members positioned in telescoping relation for limited longitudinal movement of one relative to the other, b) a seal means disposed between said outer and inner tubular members, said seal means defining a fluid-containing outer chamber therebetween, c) a first piston, said first piston further including a rod with first and second ends, a bump plate with first and second ends, a spring with first and second ends and a check valve, d) a second piston positioned in spaced relation to said first piston assembly for movement longitudinally in said outer chamber and spaced apart to define an inner chamber within said outer chamber, e) means for moving said second piston toward said first piston assembly in response to relative movement of said tubular members in one direction, f) means for moving said first piston assembly toward said second piston in response to relative movement of said tubular members in the opposite direction, g) said outer and inner chambers being adapted to be filled with a hydraulic fluid resisting relative movement of said second piston and said first piston assembly toward each other, h) means for permitting relative movement between said second piston and said first piston when said chambers are filled with fluid, i) at least one passageway opening from a point intermediate said second piston and said first piston for flow of fluid from said inner chamber to said outer chamber, j) valve means for closing said opening to said passageway, and k) valve actuating means for opening said valve means to permit flow of fluid from said inner chamber to said outer chamber to reduce the resistance of the relative movement of said tubular members.

10. The drilling jar of claim 9 wherein said first end of said rod is in contact with said second end of said bump plate, said first end of said check valve is in contact with said second end of said rod, said spring is in contact with said second end of said check valve, and said movement of said spring in a first direction closes said check valve and movement of said rod in a second direction opens said check valve.

11. A conversion mechanism adaptable with a conventional dual-acting hydraulic drilling jar for converting said dual-acting hydraulic drilling jar into a single-acting hydraulic drilling jar consisting of a tubular mandrel, the mechanism comprising:

a) a hydraulic chamber defined by a first and a second piston, the first piston including a bump plate having first and second ends;

b) a rod having first and second ends, wherein said first end of said rod is in contact with said second end of said bump plate;

c) a check valve having first and second ends, wherein said first end of said check valve is in contact with said second end of said rod;

d) a spring in contact with said second end of said check valve, wherein movement of said spring in a first direction closes said check valve and movement of said rod in a second direction opens said check valve; and e) a tripping valve in contact with said hydraulic chamber.

12. The piston of claim 11 wherein said rod and said bump plate are connected to form one object.

13. The piston of claim 11 where said bump plate further comprises a first end having first and second legs.

14. The piston of claim 11 wherein said length of said first leg is greater than said length of said second leg.

15. The piston of claim 11 wherein said first leg operatively contacts with said mandrel.

* * * * *